United States Patent [19]

Patel et al.

[11] 3,938,693

[45] Feb. 17, 1976

[54] NON-DETACHABLE EASY OPEN FLAP AND TAB ASSEMBLY

[75] Inventors: Anil U. Patel, Chicago; James V. DePhillips, Bolingbrook; Harry A. Peyser, Olympia Fields, all of Ill.

[73] Assignee: Continental Can Company, Inc., New York, N.Y.

[22] Filed: Feb. 10, 1975

[21] Appl. No.: 548,494

Related U.S. Application Data

[63] Continuation of Ser. No. 438,908, Feb. 1, 1974.

[52] U.S. Cl. ..... 220/267; 220/268; 220/90.6; 220/277; 220/367; 222/81; 222/82; 222/541

[51] Int. Cl.[2]B65D 43/02; B65D 17/00; B65D 17/24

[58] Field of Search ..... 220/267, 268, 269, 90.6, 220/277, 367; 222/541, 81, 82

[56] References Cited

UNITED STATES PATENTS 3,860,143 1/1975 Strole et al. ..... 220/269

3,877,604 4/1975 Brown ..... 220/267

*Primary Examiner*—George T. Hall

*Attorney, Agent, or Firm*—John J. Kowalik; Joseph E. Kerwin; William A. Dittmann

[57] ABSTRACT

A container end panel having a non-detachable flap portion partially severable from the panel to provide an opening. The flap portion is recessed below the remainder of the panel and is broken away by a fitment which fits into the recess. The fitment is adapted to be pushed inwardly and after rupturing the score between the panel and the flap functions to swing the flap inwardly about a hinge formed by the unscored metal connecting the flap to the panel. The fitment is pressed into the opening and snaps within the opening and provides a guard shielding the users finger from the raw edges at the tear edge about the opening. The invention is also directed to a formation of the inner edge of the ring to facilitate rupturing the score and thereafter swinging the panel inwardly.

10 Claims, 13 Drawing Figures

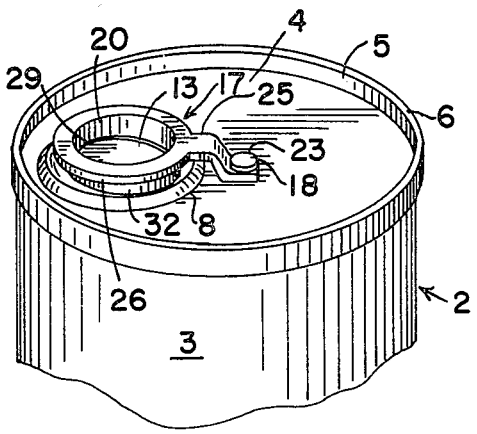
FIG. 1.
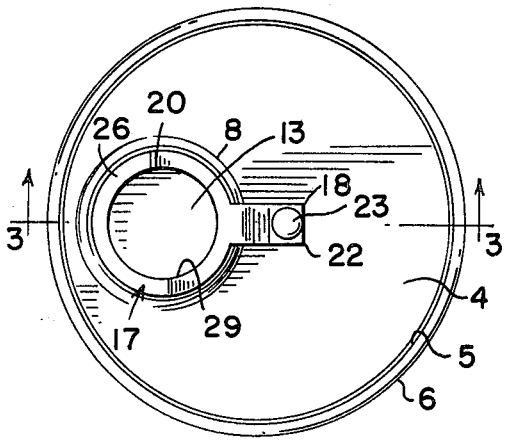
FIG. 2.
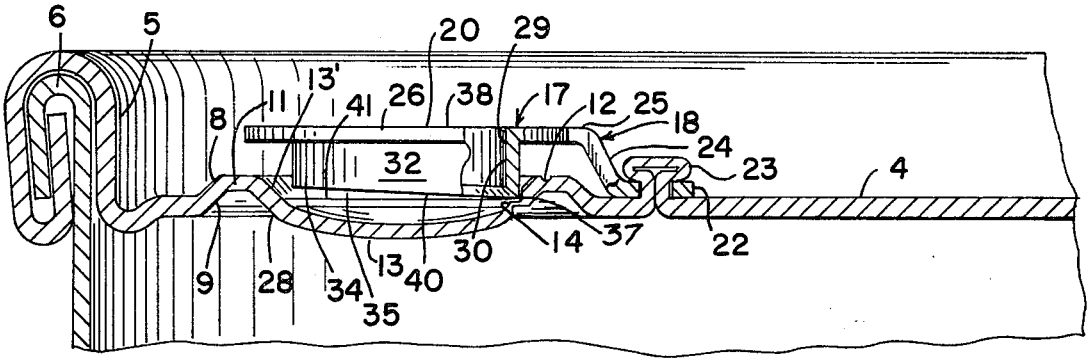
FIG. 3.
FIG. 4.
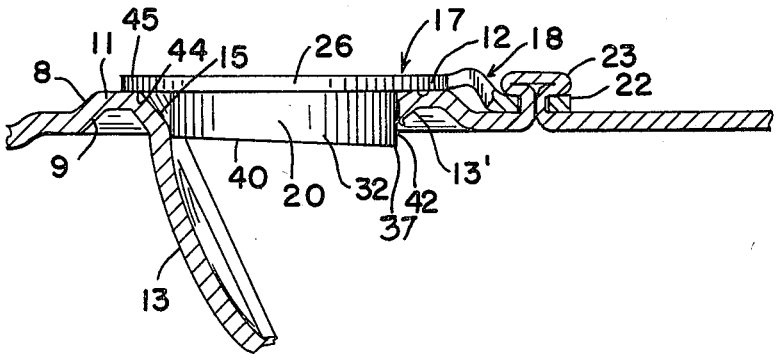

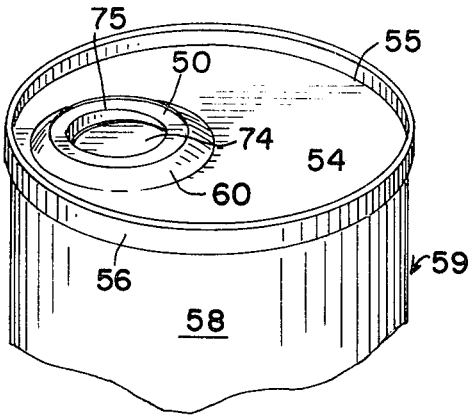
FIG. 5
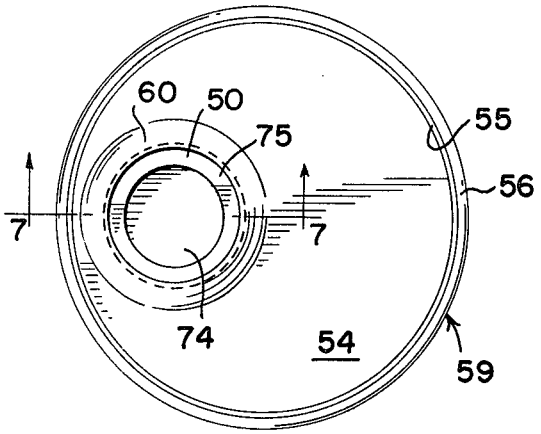
FIG. 6
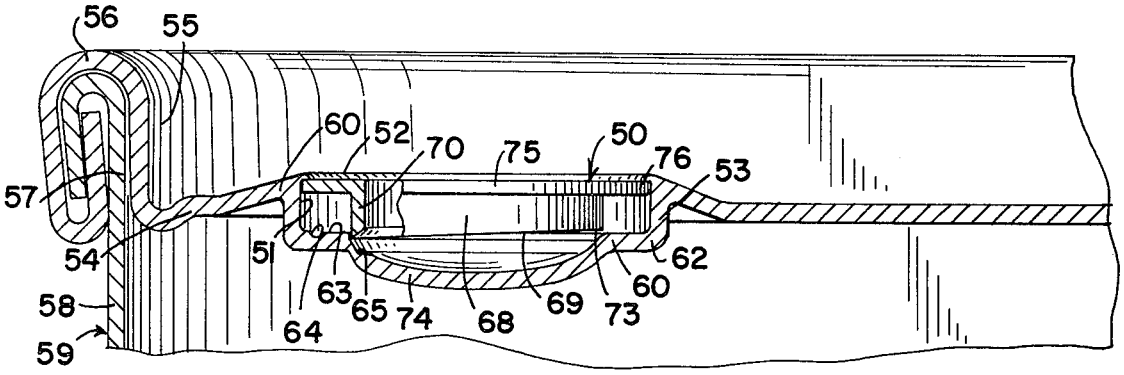
FIG. 7
FIG. 8
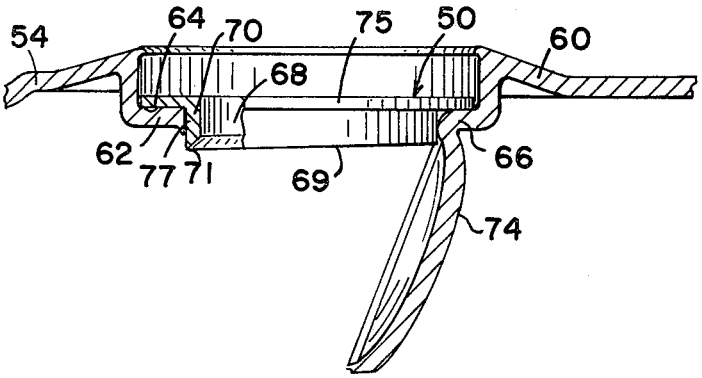

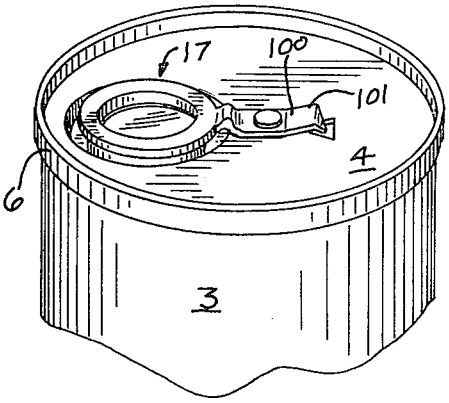
FIG. 9
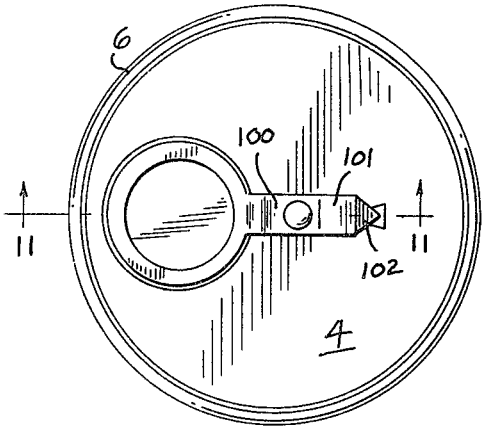
FIG. 10
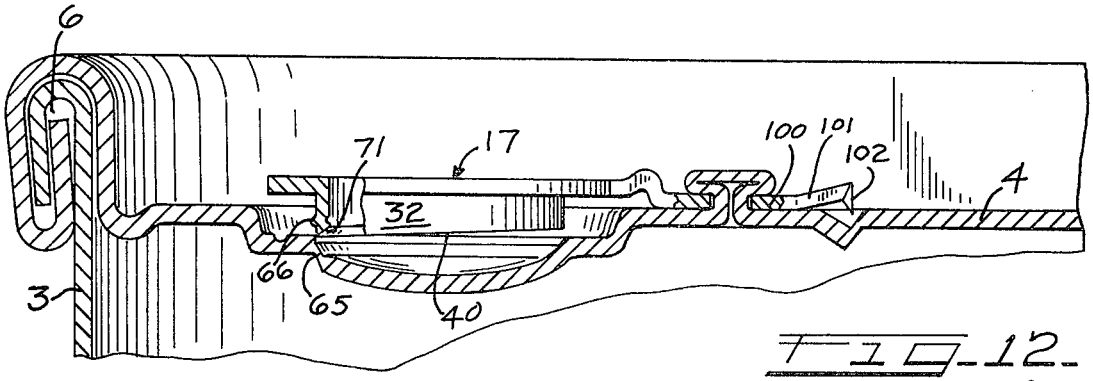
FIG. 11
FIG. 12
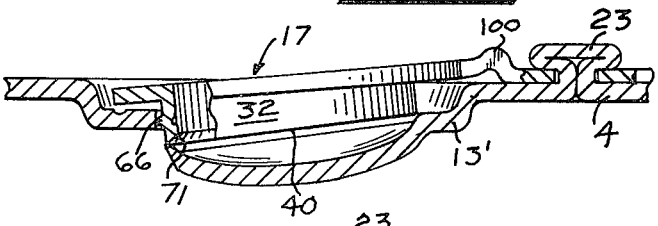
FIG. 13
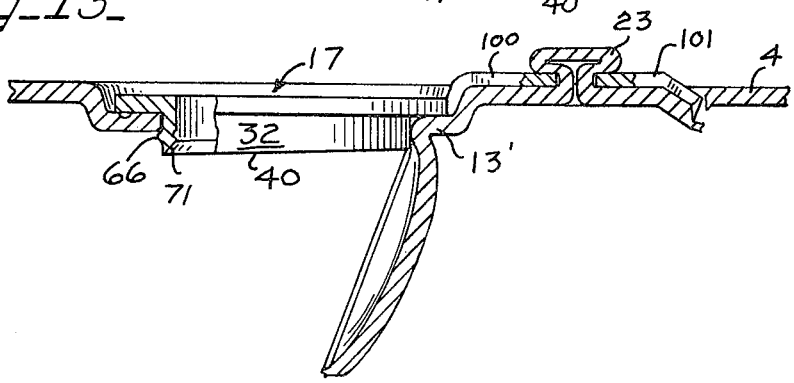

NON-DETACHABLE EASY OPEN FLAP AND TAB ASSEMBLY

This is a continuation, of Ser. No. 438,908, filed Feb. 1, 1974.

BACKGROUND OF THE INVENTION

Many attempts have been recently made to provide an ecologically acceptable container opener wherein the parts are not separable from the container. Recent interest is dominated by the push-in types in which the end panel of the container is partially scored and the resulting flap is adapted to be pressed into the container. One of the principal problems has been in either reducing the force required to rupture the score or in providing a leverage mechanism which is unobtrusive and will not interfere with drinking directly from the can. At the same time, the structure must be economically feasible. Furthermore, there is objection by users to pushing their fingers into the contents of the can.

SUMMARY OF THE INVENTION

This invention is directed to a novel non-detachable push-in easy opening closure for the end panel of a can and which precludes the necessity for the user inserting his finger into the can.

A specific object is to provide such closure formed by partially severing a portion from the can end to leave the portion attached thereto by a hinge, the portion being engaged periphery by a tubular opener which is adapted to be pushed inwardly by the user pressing thereagainst, the end of the opener bearing against the closure portion being formed to initially concentrate the opening force in a limited area to minimize the rupturing load and then functioning to bend the closure portion into the can away from the opening.

Another object is to provide a novel opener of the type described in combination with a crush-score of a type which can be fractured with a small force in the range of four to six pounds.

A further feature of the invention is to devise a novel easy opening closure which incorporates a punch type tubular opener held captive in a well formed in the end panel of the can about the closure.

A corollory object is to provide a novel opener as defined which is tethered to the container.

The invention also comprehends the use of the tubular opener in close fitting association with the edge of the opening so that it serves a dual function not only to open the container but also as a protective liner for the edge from which the closure flap is broken away.

Another object is to provide a novel ring-type opener in which the lower edge of the ring is contoured to provide a lancing point and flat areas extending therefrom to the hinge for engagement with the flap therebeneath to swing it away from the opening in response to inward movement of the ring.

These and other objects and advantages inherent in and encompassed by the invention will become more readily apparent from the specifications and the drawings wherein:

FIG. 1 is a fragmentary perspective view of a container taken from its top end incorporating one form of the invention;

FIG. 2 is a top end view of the structure;

FIG. 3 is an enlarged cross sectional view taken substantially on line 3—3 of FIG. 2 showing the closed position of the parts;

FIG. 4 is a fragmentary portion of FIG. 3 showing the open position of the parts;

FIGS. 5–8 illustrates a modification;

FIG. 5 being a fragmentary perspective top end view of a container illustrating another embodiment of the invention;

FIG. 6 being a top plan view thereof;

FIG. 7 being a fragmentary cross-sectional view thereof taken substantially on line 7—7 of FIG. 6, showing the parts in closed position; and FIG. 8 being a fragmentary view of FIG. 7 showing the parts in open position.

FIGS. 9–13 illustrate another embodiment of the invention.

FIG. 9 being a fragmentary perspective view;

FIG. 10 a top end view;

FIG. 11 an enlarged cross-sectional view taken essentially on line 11—11 of FIG. 10;

FIG. 12 being a view similar to FIG. 11 showing the parts in an intermediate position; and FIG. 13 being a view similar to FIGS. 11 and 12 showing the parts in open position.

DESCRIPTION OF EMBODIMENT OF FIGS. 1–4

This embodiment is shown in association with a metal can generally designated 2 comprising a body side wall 3, an end panel 4 having a chuck wall 5 joined to the body by a chime 6. The end panel 4 is formed in an area between the center and the chuck wall with an annular rim 8 which has a peripheral fruto-conical side wall 9 adjoining at its upper edge a preferably flat web 11 which is formed its upper side with an antirupture V-score 12. The web 11 adjoins a downwardly coned inner wall 13' which at its base is formed with the crush score 14, said score 14 partially encircling an annular downwardly disked flap 13. The uncrushed area provides a hinge portion 15 which connects the flap with the end panel wherein the flap is torn away from the panel and pushed into the container as hereinafter described.

The flap 13 is opened by a tab 17 which has an anchor lug 18 at one end and a ring 20 at its other end. The Z-shaped anchor strap 18 is preferably fastened at its distal end portion 22 to a rivet 23 formed in the center of the end panel. The portion 22 is connected to one end of a diagonal upwardly sloping web portion 24 which is in turn connected to one end of a horizontal portion 25 the other end of which is integral with a peripheral edge of an annular horizontally disposed flange 26 of the ring portion of the tab. The flange 26 is slightly diametrically larger than the uppermost diameter of the depression or cavity 28 (FIG. 2) as defined by the inner web 13 of the rim and has a center opening 29 which is coaxial with a bore 30 of a cylindrical ring or tube 32 which is integral with the flange and depends therefrom and in normal position has its lower edge portion 34 nested within the widest upper portion of the cavity 28 defined by the web 13 of the rim.

The ring 32 is spaced with its lower edge 35 slightly above the score 14 and is dimensioned to fit thereinto. The edge 35 is diagonal to the axis of the ring at an inclination of from 5°–10°. The ring is of greatest depth adjacent to the hinge or anchor lug and is sharpened thereat along a sector of about 30° to provide a lance 37 which is adapted upon pressure being applied to the upper end 38 of the tab to rupture the score 14; further pressure causing the receding flat portion 40 of the lower edge to contact the upper edge 41 of the score and to progressively tear the flap away from the panel to form the pour opening 42 through which the tubular ring extends to provide a leakproof fit therewith. The ring is pushed in until the bottom edge 44 rests upon the upper edge 45 of the top web 11 of the rim 8. As the ring portion is being moved inwardly, the anchor strap 18 is bent or deformed, but not broken. As best seen in FIG. 3 preferably the cutting edge or lance portion is located adjacent to the center of the container. In this position accidental rupture is minimized as when the can is dropped or another can stacked thereon and slips off the chime.

EMBODIMENT OF FIGS. 5–8

This embodiment is similar to the previous one except that in this instance the ring or opener 50 is held captive in a cavity 51 beneath an inturned lip 52 formed at the upper edge of an annulus 53 which is upset from the metal of the end panel 54.

The panel 54 is provided with a chuck wall 55 which is connected into a chime 56 with the upper edge 57 of the body side wall 58 of the container generally designated 59.

The upper edge of the annulus or cylindrical wall 53 defining the cavity structure is joined by the upper edge of a frusto-conical rim wall 60 which flares downwardly into the end panel wall.

The lower edge of the cavity wall 53 is integral with a ledge wall 62 which in its top face 63 is formed with a circular antirupturing score 64. The ledge wall is formed with an incomplete circular crush score 65 which at its terminus end defines a hinge strip 66 (FIG. 8).

The opener ring 50 is of cylindrical configuration having a ring body portion 68 which is of the same diameter as the score 65 and has a lower edge 69 disposed in a plane diagonally extending to the axis of the body portion.

The deeper side 70 of the ring has a sharpened sector or lance 71 of about 25° to 30° in extent. The remainder of the lower edge 69 is flat and extends to the hinge strip 66 and in the unopened position of the container is slightly spaced upwardly therefrom as at 73.

A flap 74, which is disked downwardly, is formed during the crush scoring and is adapted to be torn from the end panel commencing in the region of the lance sector 71 and progressing toward the hinge strap attendant to the flap swinging downwardly into the container as seen in FIG. 8. It will be noted that as the flap begins to break away the pressure areas shift from the initial rupture at the loaded area toward the hinge, the load shifting above the edge 69 as a consequence of the user pressing downwardly upon the opener which provides a large press area by the provision of an outturned annular flange 75 about the upper edge of the ring portion 68. The marginal edge portion 76 of flange 75 is engaged under the lip and upon the opener being pressed downwardly, the flange 75 leaves the lip and moves with the cylindrical portion until the flange 75 seats upon the ledge 62 while the portion 68 fits tightly into the torn edge 77 of the pour opening and the fluid thus is caused to flow through the tubular opener 50. The user does not soil his fingers with the contents and in the opened position is precluded from discarding any part of the opener structure.

EMBODIMENT OF FIGS. 9–13

In this embodiment parts identical to those of the previous embodiments are identified by corresponding reference numerals.

An important feature of this modification resides in having the anchor strap 100 secured intermediate its ends to the rivet 23. One end portion 101 of strap 100 is provided with a sharp point or lance 102 which is bent downwardly into a cavity 104 which is closed at its bottom by a plug 104 integral with panel 4 and defined by a triangular score 105 preferably of the crush type.

The opposite end of the strap is connected to the opener 17. In opening the container, the user presses the lance down to rupture the plug 104 as shown in FIG. 13. Then he presses down on the ring 17 breaking the score 65 as seen in FIGS. 12 and 13 and snapping the locking dimple 66 formed on the portion 32 beneath the panel wall portion 13 to prevent spring-back of the tab.

The embodiments of the invention herein disclosed are intended to illustrate several modes of utilization, and are intended to suggest other variations which will fall within the scope of the appended claims.

What is claimed is:

1. In an end panel wall for a container, a tear open flap offset below the plane of the wall within a recess therein;

a fitment telescoped into the recess and adapted to be pressed against said flap to tear open the same from the end wall to provide a raw-edge pour opening, said fitment dimensioned to tightly fit into the opening and serving as a guard shielding said raw edge of the opening and also as a spout for the contents from the container, and holding means comprising a portion of the panel wall formed to overlap said fitment and hold the same captive against said flap.

2. The invention according to claim 1 and means for holding the fitment in operative association with said flap and comprising a rigid stop on said panel wall overlapping said fitment and holding the fitment in place in alignment with said flap, said stop being sufficiently rigid to serve as an abutment shielding the fitment against accidental blows striking said fitment and unintentionally opening said flap.

3. In combination an end panel having a closure flap severable from the panel and depressed within a recess in said panel, an opener fitted within the recess, and means integral with the end panel and overlapping said opener to prevent separation of the opener from the panel.

4. The invention according to claim 1 wherein said integral means comprises an inturned lip formed integral with said panel.

5. The invention according to claim 4, and said integral lip and opener extending generally parallel to said panel.

6. The invention according to claim 5 and said opener being an annular member including a portion having an axially extending tubular portion positioned transversely of the panel and said integral means comprising a lip overlappping said opener about the periphery thereof.

7. The invention according to claim 6 and said opener being a tubular element insertable into the opening formed by removal of the flap and providing a spout for draining the contents from the container.

8. The invention according to claim 7 and said end panel having a wall portion beneath the portion of the opener and entrapping said opener between the lip and said portion of the opener.

9. The invention according to claim 8 and said portion of the opener comprising a radially extending flange disposed generally parallel to the panel.

10. The invention according to claim 9 and said lip being formed as a fold of said panel.

* * * * *